United States Patent [19]

Nørskov

[11] Patent Number: 4,736,893

[45] Date of Patent: Apr. 12, 1988

[54] NOZZLE, PARTICULARLY AN ATOMIZING NOZZLE FOR OIL BURNERS

[75] Inventor: Preben Nørskov, Nordborg, Denmark

[73] Assignee: Danfoss A/S, Nordborg, Denmark

[21] Appl. No.: 946,927

[22] Filed: Dec. 29, 1986

[30] Foreign Application Priority Data

Jan. 31, 1986 [DE] Fed. Rep. of Germany ..... 3602941

[51] Int. Cl.[4] ..... B05B 1/14

[52] U.S. Cl. ..... 239/590.3; 239/462; 239/493; 239/590.5; 239/600

[58] Field of Search ..... 239/462, 468, 493, 590, 239/590.3, 590.5, 600, DIG. 19, DIG. 23

[56] References Cited

U.S. PATENT DOCUMENTS

| | | | |
|---|---|---|---|
| 3,672,578 | 6/1972 | Wayne | 239/493 |
| 3,711,242 | 1/1973 | Bowman | 239/468 |
| 4,589,596 | 5/1986 | Stumpp et al. | 239/600 |
| 4,611,758 | 9/1986 | Geberth, Jr. | 239/600 |

FOREIGN PATENT DOCUMENTS

| | | | |
|---|---|---|---|
| 2708138 | 8/1978 | Fed. Rep. of Germany | 239/462 |
| 134751 | 10/1980 | Japan | 239/468 |
| 542013 | 3/1977 | U.S.S.R. | 239/468 |

*Primary Examiner*—Andres Kashnikow
*Assistant Examiner*—Michael J. Forman
*Attorney, Agent, or Firm*—Wayne B. Easton; Clayton R. Johnson

[57] ABSTRACT

An atomizing nozzle for oil burners that includes a housing having a front wall with an orifice in the front end thereof, a distributor insert abutting against the front wall and a retainer member that abuts against the distributor insert and is retained in place by a housing annular shoulder deformed into a retainer member groove. The retainer member is of a sintered material and includes a retainer element integrally joined to a filter element which extends rearwardly of the housing, the retainer member having a fluid passage opening to the distributor insert and extending rearwardly of the housing.

9 Claims, 1 Drawing Sheet

NOZZLE, PARTICULARLY AN ATOMIZING NOZZLE FOR OIL BURNERS

The invention relates to a nozzle, particularly an atomizing nozzle for oil burners, of which the housing carries the nozzle orifice in a front wall closing a bore and, therebehind, a distributor insert held against the wall by the end of a retaining element secured at the housing against axial movement.

In known atomizing nozzles of this kind, the distributor insert serves to feed liquid to the nozzle orifice radially from the outside and thereby to produce a twist with the aid of oblique passages provided at the end of the insert. The retaining element is a hollow screw nipple provided with radial bores and engaged in an internal screwthread of the housing. With the aid of the same internal screwthread, a filter element is also retained which consists of a hollow carrier and a screen secured thereto. The filter element serves to keep dirt particles away from the nozzle orifice to prevent a blockage. Nevertheless, such a blockage will occasionally occur.

The invention is based on the problem of further minimizing the danger of a blockage of the nozzle orifice.

This problem is solved according to the invention in that the housing comprises at least one fixing section which is deformed radially inwardly and engages an abutment which secures the axial position of the retaining element.

This construction is based on the consideration that every relative rotation between the parts of the nozzle, i.e. at least the housing, the distributor insert and the retaining element, can cause shavings to be peeled from the screwthread or the superposed faces and, depending on their size, these can block the nozzle. On the other hand, if the axial position of the retaining element is obtained merely by radial deformation of parts of the housing, no shavings can be formed. This drastically reduces the danger of blockages.

If the housing also carries a filter element, it is advisable for the housing to comprise at least one fixing section which is deformed radially inwardly and engages behind an abutment securing the axial position of the filter element. There will therefore likewise be no danger of forming shavings when applying the filter element.

With particular advantage, the fixing section is a beaded rim and the abutment is an annular shoulder. During assembly, the relative rotary position of the individual parts will then be immaterial. In addition, one can in this way also form a seal for separating an outer and an inner working space.

If the housing has an external screwthread, the fixing section should be disposed behind the external screwthread. At this position, deformation is possible without detrimentally influencing the external screwthread.

It is also favourable for the retaining element disposed between the distributor insert and the filter element to have its axial position secured by fixing the filter element. The entire construction is then simplified because only one fixing device is necessary for the retaining element and the filter element.

For example, the front face of the filter element can press on the rear end of the retaining element. However, a still simpler construction is obtained if the retaining element and filter element are fixed to each other.

In a preferred construction, the retaining element and/or filter element are made from sintered material. A sintered body can be fixed directly to the housing with a beaded rim or the like. It therefore becomes unnecessary to have a carrier for the actual filter. Sintered material is also suitable for retaining purposes because the axial forces to be transmitted from the retaining element to the distributor insert need not be all too large. In operation, the distributor insert is pressed against the front wall under the pressure of the supplied liquid.

It is favourable for the retaining element and filter element to form a common body. One obtains an element having a double function but only one fixing.

In a preferred embodiment, the common body has within the housing bore a first section serving as a retaining element which leaves a supply passage free between itself and the bore, a second section projecting from the back of the housing and serving as the filter element, and a blind passage which extends from the front end into the second section and of which the end cross-section is completely covered by the distributor insert.

By combining the retaining element and filter element, one obtains a comparatively long sintered body. This is utilized to form two consecutive filtering actions, namely one in the filter element and one in the retaining element.

It is in this case favourable to provide between the first and second sections a fixing section with an annular shoulder behind which there engages a beaded rim formed at the rear of the housing. This not only provides efficient axial fixing but also a seal between the two filter sections through which the flow passes successively.

The annular shoulder may bound a circumferential groove against the base of which the beaded rim lies. Lying against the base of the groove improves the seal.

The first section of the common body is preferably provided with axial grooves at the outside. In this way, the first section is radially traversed with a uniform circumferential distribution and therefore also uniformly loaded with regard to the filter effect. In addition, the liquid can flow between the distributor insert and the housing bore in a uniform distribution.

It is here also recommended for the distributor insert to have axial grooves at the circumference. This permits a uniformly distributed supply of flow medium in the circumferential direction even if the distributor insert is not precisely central.

If the nozzle orifice is in an end plate which lies against a shoulder of the housing and the periphery of which is guided in a bore section of the housing, it is recommended that the end plate be enlarged in diameter by an upset portion and thereby be clamped tight in the bore section. Axial upsetting likewise brings about a radial deformation with which the end plate is connected to the other components in the housing even before assembly. This brings about a still further possibility of avoiding the formation of shavings. This is because there is no danger of the end plate first being moved out of a wrong position into the correct position under the forces created during inward deformation of the fixing device.

A method of making a nozzle is characterised in that a cylindrical part of the retaining and/or filter element of sintered material is employed as the fixing section and a circumferential groove with annular shoulder be formed by depressing the beaded rim of the sintered material. This leads to a particularly secure connection and to a simpler production of the sintered body.

A preferred example of the invention will now be described in more detail with reference to the drawing, wherein.

Figure 5:
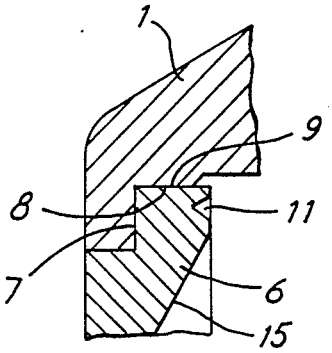
FIG. 5 is a partial cross-section through the end wall of the housing.
Figure 4:
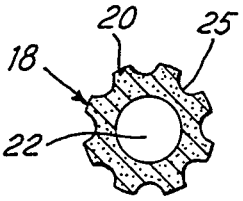
FIG. 4 is a section on the line A—A in FIG. 1 through the retaining element.

At the rear end portion of a housing 1 there is an external screwthread 2 and in front of this a hexagonal head 3. The front wall is formed by an inserted end plate 4 which carries a nozzle orifice 5 at the centre, lies against a shoulder 7 of the housing with a flange 6, and is guided by its circumference 8 in a section 9 of the front end portion of an axially elongated housing bore 10. As shown in FIG. 5, the flange 6 is provided along a circle with an upsetting notch 11 by means of which the circumference 8 is radially expanded in the zone of this upsetting notch in such a way that the end plate 4 becomes jammed in the section 10 end retains the correct position during assembly of the other components.

In a further section 12 of the bore 10 there is a distributor insert 13 having a conical end face 14 lying against a conical surface 15 at the back of the end plate 4. In this way, one obtains a distributing chamber 16 which is directly in front of the nozzle orifice 5 and to which the oil to be atomized is fed in such a way by way of oblique grooves (not shown) in the conical surface 14 that the oil leaves the nozzle orifice 5 under rotation. The distributor insert 13 has three axial grooves 17 uniformly distributed about the circumference. Together with the annular gap between the circumference of the insert and the bore section 12, these axial grooves define an adequate cross-section for the supply of oil.

Figure 1:
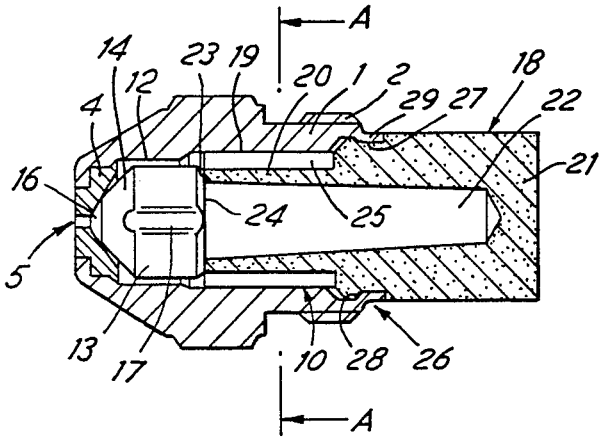
FIG. 1 is a longitudinal section through an oil burner nozzle according to the invention.
Figure 2:
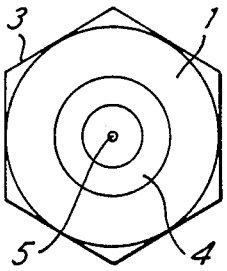
FIG. 2 is a front elevation of the nozzle housing.
Figure 3:
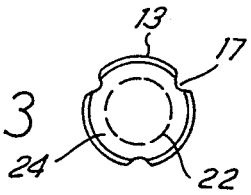
FIG. 3 is a rear elevation of the distributor insert.

A body 18 of sintered material has in a bore section 19 a first section serving as retaining element 20 and, beyond the housing, a second section serving as a filter element 21 that extends axially rearwardly of the housing rear terminal end. A blind passage 22 extends from the front side 23 of the first section almost up to the rear end of the second section and extends axially rearwardly of the housing rear terminal end. The front side 23 of the retaining element lies against the rear side 24 of the distributor insert 13. The end section of the blind passage 22 is completely closed by this side, as is shown by the broken line in FIG. 3. As may be seen from FIG. 1, the blind passage 22 from axially closely adjacent to the distributor insert to closely adjacent to the closed end of body 18 is of progressively decreasing diameters in a rearward direction.

Uniformly circumferentially distributed axial grooves 25 are provided at the outer periphery of the first section. Since this retaining element 20 is likewise of sintered material, there will be dual filtering of the arriving oil, namely once when passing from the outside through the second section (filter element 21) into the blind passage 22 and then when passing from the inside through the first section (retaining element 20) into the axial grooves 25.

The body 18 of sintered material is provided between the stated sections with a fixing section 26 which, before assembly, has a cylindrical surface. At the rear end of the housing 1 there is a fixing section 29 which, during assembly, was beaded inwardly and thus deformed radially inwardly. The beaded rim presses into the somewhat resilient sintered material to form a circumferential groove which is bounded on one side by an abutment 28 in the form of an annular shoulder. During beading, the body 18 is pressed under a predetermined pressure against the distributor insert 13 so that later accurate axial positioning of the distributor insert 13 and the body 18 is ensured. The fixing position at the same time offers a seal between the outside and the passage system formed by the axial grooves 25. This nature of axial securing positively prevents the formation of shavings during assembly.

Numerous departures can be made from the described example without departing from the basic concept of the invention. For example, the retaining element 20 and filter element 21 can be built in separately. Both elements can then be independently secured to the housing by means of a bead connection or the like. However, it is often sufficient to secure only the filter element in this manner and simply to press the retaining element axially on to the distributor insert 13. Other filter arrangements are also feasible, for example the hitherto conventional filters with a carrier and a screen but, instead of the screwthread, these are attached to the housing by a fixing device in accordance with the invention.

What is claimed is:

1. A nozzle, particularly an atomizing nozzle for an oil burner, comprising an axially elongated housing having a housing bore extending axially therethrough, a front end portion and a rear end portion that has a rear terminal end, an end plate in the bore in the housing front end portion and joined to the housing in a fixed axial position, the end plate having an orifice extending therethrough and opens to the housing bore, a distributor insert mounted in the bore in abutting relationship to the end plate to extend axially rearwardly thereof, and an axially elongated retainer member having a front retainer element in abutting relationship to the distributor insert and extending rearwardly to terminate forwardly of the housing rear terminal end, and a filter element integrally joined to the retainer element to extend axially rearwardly thereof and rearwardly of the housing terminal end, the distributor insert, retainer element and housing having cooperating means defining a supply passage located between the housing and distributor insert and retainer element that extends from between the retainer element and housing to the orifice, the retainer element having a front surface and a blind passage first portion opening through the front surface to the insert, the insert and retainer element being in liquid sealing relationship to prevent liquid flow therebetween from the blind passage first portion to the supply passage, the filter member having a blind passage second portion that opens to the first passage portion, extends rearwardly of the housing terminal end, and is closed rearwardly of the housing terminal end, the housing rear end portion and filter element having cooperating parts for retaining the retainer member in abutting relationship to the distributor insert to in turn retain the distributor insert in abutting relationship to the end plate, the retainer member being made of a sintered material such that liquid can flow from rearwardly of the housing through the filter element to the second passage portion, then from the second passage portion to the first passage portion and thereafter from the first passage portion, through the retainer element and to the supply passage.

2. A nozzle according to claim 1 wherein the retainer member cooperating part includes an annular groove and the housing cooperating part includes an annular rim bead extended into said groove, the bead and groove being located axially rearwardly of the retainer element, and the housing having external threads axially forwardly of the bead.

3. The nozzle according to claim 1 wherein the blind passage from closely adjacent the distributor insert and adjacent to its end opposite the distributor cap is of a taper to be of progressively decreasing diameters in a rearward direction.

4. A nozzle, particularly an atomizing nozzle for an oil burner, comprising a nozzle housing having a bore extending axially therethrough, a front end portion and a rear end portion, a front wall member mounted in the bore in the housing front end portion to close the bore front end portion, the wall member having a nozzle orifice extending therethrough and opening to the housing bore, a distributor insert in the housing bore in abutting relationship to the wall member, a retainer member in the housing bore in abutting relationship to the distributor insert, the housing and retainer member having cooperating means for preventing axial movement of the retainer member relative to the housing and retain the retainer member in abutting engagement with the distributor insert, the cooperating means including a retainer member annular abutment and at least one housing fixing section that is deformed radially inwardly and engages the abutment, the retainer member including a filter element extending axially rearwardly of the abutment and a retainer element having a front surface abutting against the distributor insert and being integrally joined to the filter element to extend axially fowardly thereof, the retainer and filter elements having an axially elongated blind passage that opens through the front surface to the distributor insert and is closed rearwardly of the retainer element, the housing and distributor insert having an axially extending first supply passage therebetween that opens to the orifice and extends rearwardly of the distributor insert, the retainer element and housing having an axially extending second supply passage therebetween that is forwardly of the cooperating means and opens to the first supply passage, the distributor insert and retainer element front surface being in fluid sealing relationship to block liquid flow therebetween from the blind passage to either of the supply passages, the filter and retainer elements being made of a material that permits the passage of liquid therethrough.

5. A nozzle according to claim 4 wherein the housing bore is in part defined by a rearwardly facing annular housing shoulder and that the wall member comprises an end plate abutting against the shoulder and has an upset portion abutting against the housing and within the bore whereby the end plate is clamped tight in the housing bore.

6. A nozzle according to claim 4 wherein the retainer element and distributor insert in conjunction with the housing provide a supply passage between the retainer element and housing that extends forwardly to open to said orifice, the blind passage extends axially rearwardly of the housing and the retainer and filter elements are made of sintered material that permits liquid flow from exterior of the filter element and rearwardly of the housing into the blind passage and thence from the blind passage and through the retainer element to second supply passage.

7. A nozzle according to claim 4 wherein the retainer member has an annular shoulder at the juncture of the retainer element and the filter element that faces toward the housing front end portion, that the housing fixing section comprises a beaded rim that engages the filter element axially rearwardly of said shoulder, and that the blind passage is of progressively decreasing diameters in a rearward direction from closely adjacent to the distributor insert to adjacent to its axially opposite end.

8. A nozzle according to claim 7 wherein the retainer member annular abuttment includes a circumferential groove that extends axially rearwardly of the annular shoulder and has the beaded rim extended thereinto.

9. The nozzle according to claim 4 wherein the filter and retainer elements are each made of a sintered material, and that the blind passage from axially closely adjacent to the distributor insert to adjacent the end of the passage opposite the distrubutor insert is of a taper to be of progressively decreasing diameters in a rearward direction.

* * * * *